United States Patent [19]

Perry et al.

[11] 4,412,510

[45] Nov. 1, 1983

[54] FLEXIBLE TIE FOR TANGENT TUBE CONSTRUCTION

[75] Inventors: Glenn M. Perry; Robert P. Sullivan, both of Chattanooga, Tenn.

[73] Assignee: Combustion Engineering, Inc., Del.

[21] Appl. No.: 957,623

[22] Filed: Nov. 3, 1978

[51] Int. Cl.[3] ..... F26B 37/24

[52] U.S. Cl. ..... 122/510; 122/6 A; 122/235 A; 122/476

[58] Field of Search ..... 122/6 A, 235 A, 476, 122/478, 510; 165/162, 172, 82, 81, 176; 126/442, 446, 447, 448

[56] References Cited

U.S. PATENT DOCUMENTS

| | | | |
|---|---|---|---|
| 2,757,649 | 8/1956 | Coughlin | 122/510 |
| 2,834,324 | 5/1958 | Schoessow | 122/476 |
| 2,916,263 | 12/1959 | Godshalk | 122/510 |
| 2,997,069 | 8/1961 | Bisbee | 122/510 |
| 3,880,123 | 4/1975 | Freiday | 122/476 |

*Primary Examiner*—Henry C. Yuen

*Attorney, Agent, or Firm*—Arthur E. Fournier, Jr.

[57] ABSTRACT

Tie means employable for purposes of accomplishing the tying together of tubes of a superheater platen assembly. The subject tie means is particularly suited for use in those applications wherein a need exists to effect the tying together of tubes, which bear a tangential relationship to each other. The subject tie means comprises a multiplicity of cooperating tie members that are suitably affixed such as by being welded thereto, to the pair of tubes that the tie means is intended to tie together. More specifically, the multiplicity of tie members includes a first pair of tie members that is affixed to a first one of the pair of tubes and a second pair of tie members that is affixed to the second one of the pair of tubes. Each of the multiplicity of tie members is essentially L-shaped in configuration with the first pair of tie members being oriented so as to each have a portion thereof, which projects inwardly, while a second pair of tie members is oriented so that each of the tie members has a portion thereof, which projects outwardly, whereby the inwardly projecting portions of the first pair of tie members are supported in sliding engagement with the outwardly projecting portions of the second pair of tie members thereby to effect the tying together of the aforesaid pair of tubes through the interengagement of the respective projecting portions of the first and second pairs of tie members.

6 Claims, 3 Drawing Figures

FLEXIBLE TIE FOR TANGENT TUBE CONSTRUCTION

BACKGROUND OF THE INVENTION

I. Field of the Invention

Our invention relates to means for tying together tubes in superheater platen assemblies, and more particularly, to tie means of the type that are intended to be used to tie together those tubes, which in superheater platen assemblies bear a tangential relationship to each other.

II. Description of the Prior Art

It has long been known in the prior art to provide means operative to effect the tying together of the tubes that superheater platen assemblies embody. Generally speaking, there are at least two principal reasons why it has been found desirable to employ such tie means. First of all, a need to provide support to such tubes has been shown to exist. Secondly, it has been deemed desirable to employ some form of means that would be operative to ensure that the tubes maintain their proper orientation under diverse operating conditions.

As concerns the matter of tube support, under normal operating conditions the tubes are exposed to relatively high temperatures. Such high temperatures give rise to the occurrence of differential expansion of the tubes relative to each other, as well as to the differential expansion of different portions of the same tube. The effect on the tubes of such differential expansion is to subject them to various stresses, which in turn have been known to cause the tubes to fail. Another problem associated with the exposure of the tubes to high temperatures is that of thermal cycling. More specifically, reference is had here to the fact the tubes are often subjected to expansion and contraction on cyclical basis due to changes taking place in the temperatures to which the tubes are being exposed. There have been instances in the past wherein tube failure has been known to have been occasioned by such thermal cycling.

With regard to the question of tube orientation, unless steps are taken to ensure that the desired orientation of the tubes is being properly maintained, the tubes may experience a buildup of stresses that ultimately can lead to one or more tubes failing. For purposes of this discussion, changes in orientation may be construed as encompassing the twisting of one tube relative to another, or the twisting of different portions of the same tube. Or, one tube may experience a longitudinal shift relative to an adjoining tube. Or, the relative orientation of one or moe tubes may be affected in some other fashion. Changes in tube orientation may be occasioned by a variety of different factors such as, for instance, the differential expansion to which the tubes are subjected, or from improper tube installation, etc.

Apart from the ability to provide the tubes with support, and the ability to ensure that the tubes maintain their proper orientation when subjected to operating conditions, there are several other characteristics that it would be advantageous for a tie means to possess. Reference is had here to the fact that the tie means should be susceptible to ease of fabrication as well as to ease of assembly.

There is to be found depicted in the prior art tie means of various types and configurations. For the most part, however, the prior art forms of tie means are designed to be used in those applications wherein the tubes are positioned in spaced relation to each other. Furthermore, most of the tie means that are known to exist in the prior art would be unsuitable, by virtue of the nature of their construction, for use in applications wherein a tangent tube type of construction is being employed, i.e., in situations wherein the tubes bear a tangential relationship to each other.

Although most of the attention on the part of the prior art has heretofore been directed to providing tie means, which would be suitable for use in those applications wherein it is desired that the tubes embodied in a given superheater platen assembly be spaced relative to each other, at least two different forms of tie means are known to exist that are capable of being utilized wherein tangent tube type of construction is contemplated. The two forms of tie means to which reference is had here are the hinge pin tie, and what is commonly referred to in the prior art as a tangent tie weld.

Considering first the nature of the construction of the hinge pin tie, the latter derives its name principally because of its resemblance to a conventional door hinge. One example of such a hinge pin tie can be found illustrated in U.S. Pat. No. 2,834,324—Schoessow. As shown in the latter patent a pair of hinge pin ties are utilized to effect the tying together of a pair of tubes. Each of the pair of hinge pin ties includes a multiplicity of apertured lugs or spacers. In accordance with the preferred embodiment, each hinge pin tie consists of three such apertured lugs with one lug being welded to one of the pair of tubes, and the remaining two lugs being welded to the other one of the pair of tubes. The three lugs are suitably affixed to the pair of tubes so that the single lug is capable of being received in interposed relation between the two lugs that are welded on the same tube. A pin is then inserted through the apertures of the three lugs whereby to effect an interconnection therebetween. The other hinge pin tie is of similar construction, and is assembled in a likewise fashion.

The hinge pin tie form of tie means has met with limited success when it has been employed in certain installations. One major reason for this is that the expansion spaces associated with the apertured lugs have exhibited a tendency to become plugged. Large expansion spaces give rise to overheating of the pin, which in turn can lead to tie failure. In addition, the hinge pin tie has exhibited an inability to successfully resist, i.e., remain free from damage, when the tubes with which the hinge pin tie is being employed are subject to unusual movements that produce high stress patterns.

The tangent tie weld form of construction may be viewed as consisting essentially of the establishment of a solid weld between the two tubes which are intended to bear a tangential relationship to each other. This form of tie means has been found to suffer basically from the same disadvantages as the hinge pin tie. Namely, the tangent tie weld construction has demonstrated a predilection towards functioning in an unsuccessful manner when tube-to-tube temperatures are high, or when the tubes joined by the tangent tie weld undergo unusual movements that give rise to the creation of high stress patterns.

There has thus been shown to exist in the prior art a need for a new and improved form of tie means, which would not suffer from the same disadvantage as those exhibited by prior art forms of tie means, but yet would comprise a tie means that is capable of being utilized to effect the tying together of the tubes, which are to be found embodied in superheater platen assemblies, and more specifically, a tie means that is particularly suited for use in tying together tubes, which bear a tangential relationship to each other. Such a tie means, moreover, should be characterized by its ability to provide the desired degree of support to the tubes, which it serves to join; by its ability to cause the tubes to effectively maintain their proper orientation; by the fact that it is both relatively easy to fabricate and assemble; and by the fact that it is economical both to produce and to employ.

OBJECTS OF THE INVENTION

It is therefore an object of the present invention to provide a novel and improved tie means operable for tying together tubes contained in a superheater platen assembly.

It is another object of the present invention to provide such a tie means, which is particularly applicable for use in tying together the tubes of superheater platen assembly, wherein the tubes to be joined bear a tangential relationship to each other.

A further object of the present invention is to provide such a tie means, which is capable of performing the function of providing support to the tubes of a superheater platen assembly.

A still further object of the present invention is to provide such a tie means, which is capable of performing the function of ensuring that the tubes of the superheater platen assembly joined thereby maintain the orientation desired thereof.

Yet another object of the present invention is to provide such a tie means, which is characterized by the relative ease with which it can be fabricated.

Yet still another object of the present invention is to provide such a tie means, which is characterized by the relative ease with which it can be assembled.

Yet still a further object is to provide such a tie means that will not become slag bound.

Yet a final object of the present invention is to provide such a tie means, which is economical both to produce and to employ.

SUMMARY OF THE INVENTION

In accordance with a preferred form of the invention, there is provided a novel and improved tie means operable for tying together tubes of a superheater platen assembly. The subject tie means, which is particularly suited for use in tying together tubes that bear a tangential relationship to each other, consists of four tie members employed as pairs. Each of the four tie members is essentially L-shaped in configuration. One of the two pairs of tie members is suitably affixed, such as by welding, to one of the pair of tubes, which is to be tied together by the subject tie means. The other pair of tie members is similarly suitably affixed, such as by welding, to the other of the pair of tubes which is to be tied together by the subject tie means. Each of the L-shaped tie members of the first pair thereof is oriented on the tube to which it is welded so as to have a portion thereof projecting inwardly, whereby the inwardly projecting portions of the two tie members of the first pair thereof face towards each other. Likewise, each of the L-shaped tie members of the second pair thereof is oriented on the tube to which it is welded so as to have a portion thereof projecting outwardly, whereby the outwardly projecting portions of the two tie members of the second pair thereof face away from each other. Moreover, the tie members of the first pair thereof are oriented relative to the tie members of the second pair thereof so that the inwardly projecting portions of the former are supported in sliding engagement with the outwardly projecting portions of the latter. The tying together of the pair of tubes, which bear a tangential relationship to each other, is effected through the interengagement of the respective projecting portions of the first and second pairs of tie members of the subject tie means.

The invention will be more fully understood from the following detailed description and its scope will be pointed out in the appended claims.

DESCRIPTION OF A PREFERRED EMBODIMENT

This invention is disclosed in relation to a recovery unit platen superheater. However, it should be recognized that the subject matter of our invention is not limited to embodiment in recovery unit platen superheaters, but is equally applicable to being employed as part of other and different types of superheater assemblies.

Figure 1:
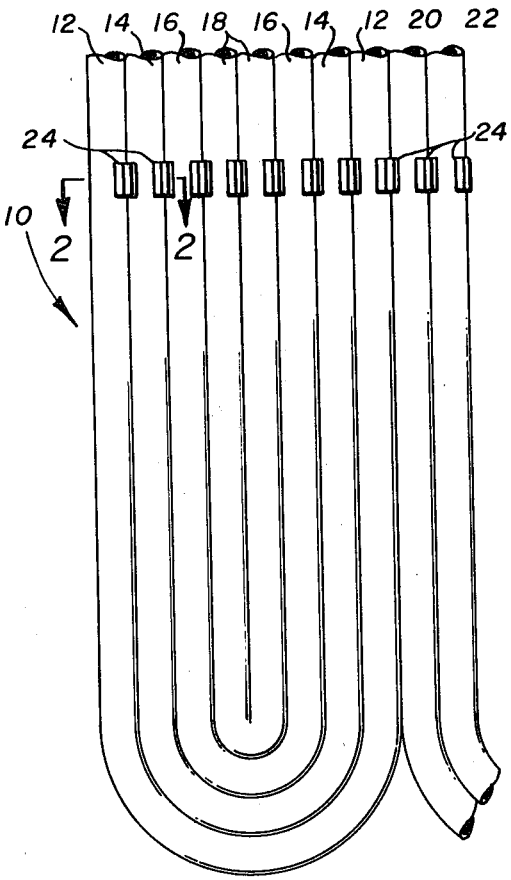
FIG. 1 is a side elevational view of a portion of a recovery unit platen superheater embodying tie means constructed in accordance with the present invention.

Referring now to the drawing and more particularly to FIG. 1 thereof, there is depicted therein a portion of a recovery unit platen superheater, generally designated by reference numeral 10. Inasmuch as the construction of recovery unit platen superheaters is well-known to those skilled in the art, it is not deemed necessary for purposes of acquiring an understanding of the present invention that there be recited herein all of the details of construction of the recovery unit platen superheater 10, or that all of the details of construction of the latter be illustrated in the drawing. Rather, it is deemed sufficient to simply note that as shown in FIG. 1, the recovery unit platen superheater 10 includes a multiplicity of tubes 12, 14, 16, 18, 20 and 22, and that tie means, generally designated by reference numeral 24, the latter being constructed in accordance with the present invention, are interposed between adjoining ones of the tubes 12, 14, 16, 18, 20 and 22. Each of the tubes 12, 14, 16, 18, 20 and 22, as illustrated in FIG. 1, is substantially U-shaped in configuration, and is arranged such that all of the tubes 12, 14, 16, 18, 20 and 22 bear a tangential relationship to each other. The tie means 24 in turn operate to tie together the tubes 12, 14, 16, 18, 20 and 22 in a manner such that there exists tangential engagement between adjoining ones of the tubes 12, 14, 16, 18, 20 and 22.

Figure 2:
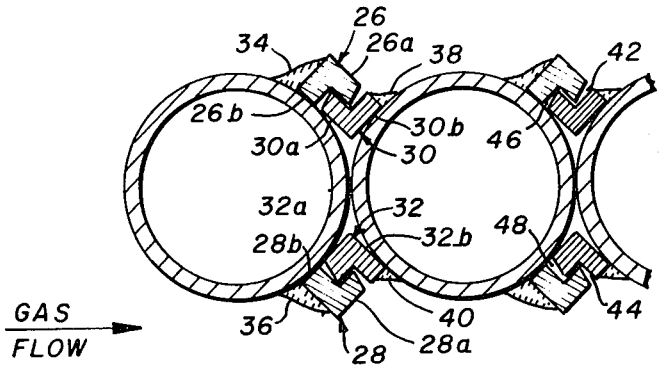
FIG. 2 is a cross-sectional view of a pair of tie means constructed in accordance with the present invention, taken substantially along the line 2—2 in FIG. 1 of the drawing.
Figure 3:
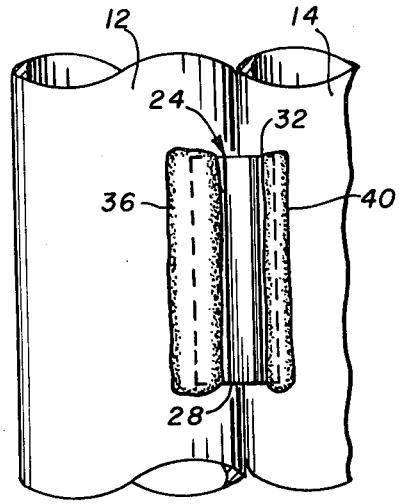
FIG. 3 is a side elevational view on an enlarged scale of a tie means constructed in accordance with the present invention.

Turning now to a description of the nature of the construction of the tie means 24, which forms the subject matter of the present invention, reference will be had for this purpose particularly to FIGS. 2 and 3 of the drawing. As best understood with reference to FIG. 2, each of the tie means 24 consists of a multiplicity of tie members. More specifically, in accordance with the preferred embodiment of the invention, each tie means 24 consists of four tie members 26, 28, 30 and 32, which are employed in pairs.

Continuing with a description of the nature of the construction of the tie means 24, each of the tie members 26, 28, 30 and 32 is generally L-shaped in configuration. Namely, each of the tie members 26, 28, 30 and 32 includes a first portion 26*a*, 28*a*, 30*a* and 32*a*, respectively, and a second portion extending substantially at right angles thereto designated by the reference numerals 26*b*, 28*b*, 30*b* and 32*b*, respectively. The tie members 26 and 28 as shown in FIG. 2, are suitably affixed to the tube 12 so as to be positioned in spaced relation to each other. Similarly, the tie members 30 and 32 are suitably affixed to the tube 14 so as to be positioned in spaced relation to each other. In accordance with the preferred embodiment of the invention, the affixation of the tie members 26 and 28, and more specifically the portions 26*b* and 28*b*, respectively, thereof to the tube 12 is effected through welding, while the affixation of the tie members 30 and 32, and more specifically the portions 30*b* and 32*b*, respectively, thereof to the tube 14 is also accomplished by welding. In summary, tie members 26 and 28 are affixed to tube 12 by means of welds 34 and 36, respectively, and tie members 30 and 32 are affixed to tube 14 by means of welds 38 and 40, respectively. For reasons which will be discussed more fully hereinafter, the welds 34 and 36 are preferably larger in size than are the welds 38 and 40.

With reference again to FIG. 2 of the drawing, the tie members 26 and 28 in their mounted position on the tube 12 are suitably oriented so that the portions 26*a* and 28*a*, respectively, thereof face inwardly, i.e., in a direction towards each other. Similarly, the tie members 30 and 32 in their mounted position on tube 14 are suitably oriented so that the portions 30*a* and 32*a*, respectively, thereof face outwardly, i.e., in a direction away from each other. Moreover, as best understood with reference to FIG. 2, tie member 26 is suitably located on and suitably oriented with respect to the circumference of tube 12, and tie member 30 is suitably located on and suitably oriented with respect to the circumference of the tube 14 such that the portion 26*a* of tie member 26 is positioned so as to be in abutting relation to and in sliding engagement with the portion 30*a* of tie member 30. In a like manner, the tie member 28 is suitably located on and suitably oriented with respect to the circumference of the tube 12, and the tie member 32 is suitably located on and suitably oriented with respect to the circumference of the tube 14 such that the portion 28*a* of tie member 28 is positioned so as to be in abutting relation to and in sliding engagement with the portion 32*a* of tie member 32. More specifically, as illustrated in FIG. 2, with the tubes 12 and 14 in tangential engagement with each other along the lengths thereof, the tie means 24 constructed in accordance with the present invention functions to tie the tubes 12 and 14 together through the interengagement of the portions 26*a* and 30*a* of the tie members 26 and 30, respectively, and through the interengagement of the portions 28*a* and 32*a* of the tie members 28 and 32, respectively. Note should be taken here of the fact that in accordance with the preferred form of the invention, the two outer most tie members of the tie means 24, i.e., tie members 26 and 28 face inwardly, while the other pair of tie members of the tie means 24, i.e., tie members 30 and 32 face outwardly and are interposed between the inwardly extending tie members 26 and 28.

Turning now to the matter of the welds 34, 36, 38 and 40, as will be best understood with reference to FIGS. 3 and 2 of the drawing, each of these welds is purposely deposited in such a fashion that the weld extends around both the top and bottom ends of each of the corresponding tie members 26, 28, 30 and 32. Namely, as viewed with reference to FIG. 3 of the drawing, the weld 36 extends around the tie member 28 at both the latter's top and bottom ends. Similarly, the weld 40 extends around the tie member 32 both at the latter's top and bottom ends. The effect of utilizing this method of depositing the welds 34, 36, 38 and 40 relative to the tie members 26, 28, 30 and 32, respectively, is to foster the establishment of a strong weld between the tie members 26, 28, 30 and 32 and the tubes 12 and 14.

Reference has been had hereinabove to the fact that in accordance with the preferred form of the invention, the welds 34 and 36 are larger in size than the welds 38 and 40. In addition, the larger welds, i.e., welds 34 and 36 are purposely employed to affix the outer most two members of the tie means 24, i.e., tie members 26 and 28 to the tube 12. Moreover, the pair of tie members of the tie means 24, which constitute the outer most pair thereof, i.e., tie members 26 and 28, in accordance with the description previously set forth hereinabove and with the illustrations contained in the drawing are oriented relative to the path of gas flow through the recovery unit platen superheater 10 such that the welds 34 and 36 associated with the tie members 26 and 28, respectively, are the first to be struck by the gas flow. By virtue of the arrangement above, the welds 34 and 36, which are the larger in size of the two sets of welds, receive a greater amount of heat than do the smaller welds 38 and 40. More specifically, although the welds 34 and 36 see the gas flow first and thereby are susceptible to be heated to a greater extent than the set of welds 38 and 40, by virtue of their larger volume the welds 34 and 36 nevertheless run cool, i.e., the temperatures thereof remain within acceptable limits.

The final aspect of the nature of the construction, which remains to be described to complete the description of the tie means 24, is the fact that, as will be best understood with reference to FIG. 2 of the drawing, the free edges of each of the tie members 26, 28, 30 and 32 is intentionally provided with a taper. In the interest of maintaining clarity of illustration in the drawing, the tapers associated with the tie members 26, 28, 30 and 32 are not provided with reference numerals. One benefit, which is to be derived from providing the tie members 26, 28, 30 and 32 with such a taper is that the latter thereby embody less metal, and as a consequence theoretically experience a lower heat rise when exposed to the hot gases, which flow through the recovery unit platen superheater 10.

More importantly, however, the taper with which the free edge of each of the tie members 26, 28, 30 and 32 is provided serves two other very useful purposes in connection with the welding of the tie members 26, 28, 30 and 32 to the tubes 12 and 14. First, as illustrated in FIG. 2 of the drawing, by providing the free edge of each of the tie members 26, 28, 30 and 32 with a taper, a gap is effectively established between cooperating portions of the tie members 26, 28, 30 and 32 when the latter are in the assembled condition, i.e., when tie member 26 is interengaged with tie member 30, and tie member 28 is interengaged with tie member 32. The existence of these gaps minimizes the likelihood that during welding cooperating tie members, i.e., tie members 26 and 30, and tie members 28 and 32, will be become welded together. Namely, the aforesaid gaps are sufficiently large that it is extremely unlikely that the weld metal being deposited would accidently flow into one or more of the gaps in sufficient amounts as to effectively span the width of the gap and thereby cause a welding together of a cooperating pair of tie members.

Secondly, the aforesaid gaps serve to facilitate the task of inspection following assembly of the tie means 24 and the tubes 12, 14, 16, 18, 20 and 22. Namely, the inspector checking to determine that the tie members 26 and 30, and/or the tie members 28 and 32 have not accidentally been welded together thereby preventing the occurrence of sliding movement therebetween need only determine whether the desired gap is present between cooperating portions of the tie members 26, 28, 30 and 32. A visible inspection of the tie means 24 is easily performed. Moreover, the performance of such inspections produces results of acceptable accuracy. The gaps to which reference has been had hereinabove can be found depicted in FIG. 2 of the drawing and are designated therein by the reference numerals 42, 44, 46 and 48.

Although a description of only one tie means 24, i.e., the tie means 24, which serves to tie together one leg of each of the tubes 12 and 14 has been set forth hereinabove, it is to be understood that all of the other tie means 24 depicted in FIG. 1 of the drawing are of identical construction. For this reason it has not been deemed necessary to repeat herein a recitation of the details of construction of the remainder of the illustrated tie means 24. As concerns the number of tie means 24 to be employed in a given recovery unit platen superheater, this varies. Generally speaking, however, as many tie means 24 are employed in a given installation as is deemed necessary. To this end, in accordance with the preferred form of the invention, tie means 24 are preferably positioned so as to be spaced on nine to fourteen foot centers along the length of each pair of adjoining tubes.

In accordance with the best mode of the invention contemplated, each tie means 24 consists of four substantially L-shaped tie members 26, 28, 30 and 32, which are welded to a pair of adjoining tubes that bear a tangential relationship to each other. The tie members 26, 28, 30 and 32 are capable of being fabricated by means of a stamping operation. This is in contrast to prior art forms of tie means wherein the elements thereof are generally required to be cast. Significant savings in cost of fabrication are thus capable of being realized from the employment of the tie means 24 as compared to the cost of fabrication incurred when using other known prior art forms of tie means. The four tie members 26, 28, 30 and 32 are designed to be employed in pairs with two of the tie members, i.e., tie members 26 and 28 each having a portion, i.e., portions 26*a* and 28*a*, respectively, facing inwardly, while the other two of the tie members, i.e., tie members 30 and 32, each have a portion, i.e., portions 30*a* and 32*a*, respectively, facing outwardly. The mode of operation of the tie means 24 is such that the latter is effective to tie together an adjoining pair of tubes through the interengagement of cooperating portions of the tie members 26 and 30, and the interengagement of cooperating portions of the tie members 28 and 32. Moreover, in accordance with the best mode of the invention contemplated, a multiplicity of tie means 24 are employed in any given application thereof with the tie means 24 being spaced approximately on nine to fourteen foot centers. Also, each of the tie members 26, 28, 30 and 32 is preferably approximately two inches long or as long as may be required. In addition, the free edge of each of the tie members 26, 28, 30 and 32 is tapered. Finally, the welds, i.e., welds 34 and 36 by means of which the tie members 26 and 28 are affixed to the tube 12 are larger in size than are the welds 38 and 40 that are employed to affix the tie members 39 and 32 to tube 14.

Tests of the tie means 24 have demonstrated that the tie means 24, wherein the tie members thereof are each approximately one and a half inches long and the tubes embody wall thicknesses of 0.260, is capable of withstanding a pull of up to 7500 lbs. before separation. With tie members that are each one and a half inches long and tubes that embody wall thicknesses of 0.135, the tie means 24 has successfully withstood a pull of up to 6460 lbs. before separation occurred. The strength exhibited by the tie means 24, when subjected to the aforementioned pull tests, is attributable at least in part to the strong weld that is established between the tie members and the tubes, and in part to the fact that the innermost tie members, i.e., outwardly facing tie members 30 and 32, resist the tendency to separate from engagement with the other two tie members, i.e., tie members 26 and 28, under pull test conditions by virtue of the fact that the free edge of each of the tie members 30 and 32 bears against the outer circumference of the adjoining tube. Namely, any tendency for the tie members 30 and 32 to rotate out of engagement with the cooperating portions of the tie members 26 and 28 under pull test conditions is inhibited by virtue of the fact that the free edges of the tie members 30 and 32 as they begin to rotate away from and thereby out of engagement with the tie members 26 and 28 engage the circumference of the tube 12, which in turn functions to prevent any substantial movement of the tie members 30 and 32 in a direction away from the tie members 26 and 28 until such time as the forces to which the tie members 30 and 32 are being subjected are no longer capable of being resisted, or else failure of the tie means 24 occurs elsewhere.

Thus, in accordance with the present invention there has been provided a novel and improved tie means operable for tying together tubes contained in a superheater assembly. The subject tie means is particularly applicable for use in tying together the tubes of a superheater platen assembly, wherein the tubes to be joined bear a tangential relationship to each other. In accordance with the preferred form of the invention, a tie means has been provided, which is capable of performing the function of providing support to the tubes of a superheater platen assembly. Further, the subject tie means is capable of performing the function of ensuring that the tubes of the superheater platen assembly joined thereby maintain the orientation desired thereof. The tie means of the present invention is characterized by the relative ease with which it can be fabricated. In addition, the subject tie means is characterized by the relative ease with which it can be assembled. Finally, in accordance with the present invention a tie means has been provided, which is economical both to produce and to employ.

While only one embodiment of our invention has been shown, it will be appreciated that modifications thereof, some of which have been noted in the preceding description, may readily be made thereto by those skilled in the art. We, therefore, intend by the appended claims to cover the modifications alluded to herein as well as all other modifications which fall within the true spirit and scope of our invention.

What is claimed is:

1. In a superheater assembly designed for employment in the flow path of a gas, the combination comprising:

a. a first tubular member supported within the superheater assembly so as to define a plane therewithin;

b. a second tubular member supported in tangential relation to said first tubular member so as to define an area of tangential engagement between said first and second tubular members, said area of tangential engagement between said first and second tubular members lying within said plane;

c. a first tie means operative for tying together said first and second tubular members at a location spaced in a first direction from said plane, said first tie means including a first tie member and a second tie member, said first tie member being attached to said first tubular member at a point spaced in said first direction from said plane so as to face in the same direction as that in which the gas flows, said second tie member being attached to said second tubular member at a point spaced in said first direction from said plane such that said second tie member is located in closer proximity to said plane that is said first tie member, said second tie member being attached to said second tubular member so as to face in a direction opposite to the direction in which the gas flows, said first tie member having a portion thereof projecting inwardly relative to said plane, said second tie member having a portion projecting outwardly relative to said plane, said inwardly projecting portion of said first tie member being engageable with said outwardly projecting portion of said second tie member in sliding relation thereto so as to effectuate a tying together of said first and second tubular members at said location spaced in said first direction from said plane; and d. a second tie means operative for tying together said first and second tubular members at a location spaced in a second direction from said plane, said second tie means including a third tie member and a fourth tie member, said third tie member being attached to said first tubular member at a point spaced in said second direction from said plane so as to face in the same direction as that in which the gas flows, said fourth tie member being attached to said second tubular member at a point spaced in said second direction from said plane such that said fourth tie member is located in closer proximity to said plane than is said third tie member, said fourth tie member being attached to said second tubular member so as to face in a direction opposite to the direction of gas flow, said third tie member having a portion thereof projecting inwardly relative to said plane, said fourth tie member having a portion projecting outwardly relative to said plane, said inwardly projecting portion of said third tie member being engageable with said outwardly projecting portion of said fourth tie member in sliding relation thereto so as to effectuate a tying together of said first and second tubular members at said location spaced in said second direction from said plane.

2. In a superheater assembly, the combination as set forth in claim 1 wherein each of said first, second, third and fourth tie members is essentially L-shaped in configuration.

3. In a superheater assembly, the combination as set forth in claim 2 wherein each of said first and third tie members further includes a second portion extending substantially at right angle to said inwardly extending portion thereof, each of said first and third tie members having said second portion thereof attached to said first tubular member.

4. In a superheater assembly, the combinations set forth in claim 3 wherein each of said second and fourth tie members further includes a second portion extending substantially at right angles to said outwardly extending portion thereof, each of said second and fourth tie members having said second portion thereof attached to said second tubular member.

5. In a superheater assembly, the combination as set forth in claim 4 wherein said inwardly extending portion of each of said first and third tie members terminates in a taper, and said outwardly extending portion of each of said second and fourth tie members terminates in a taper.

6. In a superheater assembly, the combination as set forth in claim 5 wherein said second portion of each of said first and third tie members is attached to said first tubular member by means of a first weld, and said second portion of each of said second and fourth tie members is attached to said second tubular member by means of a second weld, said first weld being larger in size than said second weld.

* * * * *